US005241897A

United States Patent [19]

Drittel

[11] Patent Number: 5,241,897

[45] Date of Patent: Sep. 7, 1993

[54] PRESSURIZED MEDIUM CYLINDER

[75] Inventor: Volker Drittel, Renningen, Fed. Rep. of Germany

[73] Assignee: Hygrama AG, Rotkreuz, Switzerland

[21] Appl. No.: 868,790

[22] Filed: Apr. 15, 1992

[30] Foreign Application Priority Data

Apr. 18, 1991 [EP] European Pat. Off. ..... 91106181.0

[51] Int. Cl.[5] ..... F01B 29/00

[52] U.S. Cl. ..... 92/88; 92/170.1

[58] Field of Search ..... 92/88, 170.1; 277/DIG. 7

[56] References Cited

U.S. PATENT DOCUMENTS

| | | | |
|---|---|---|---|
| 4,545,290 | 10/1985 | Lieberman | 92/88 |
| 4,555,980 | 12/1985 | Hoglund | 92/88 |
| 4,664,020 | 5/1987 | Kaiser | 92/88 |
| 4,685,383 | 8/1987 | Ruchser | 92/88 |
| 4,733,604 | 3/1988 | Lipinski | 92/88 |

*Primary Examiner*—Edward K. Look
*Assistant Examiner*—F. Daniel Lopez
*Attorney, Agent, or Firm*—Michael, Best & Friedrich

[57] ABSTRACT

The pressurized medium cylinder has a longitudinally extending slot. The steel strip located for sealing purposes at the inner side of the surface of the cylinder and arrested by means of magnets is equipped with an injection molded plastic encasing, which forms at the outer side of the steel strip a plastic material strip which centers the steel strip relative to the longitudinal slot.

13 Claims, 2 Drawing Sheets

PRESSURIZED MEDIUM CYLINDER

BACKGROUND OF THE INVENTION

1. Field of the Invention

The present invention relates to a pressurized medium cylinder having an inner chamber and a piston arranged for a reciprocable motion in the inner chamber; a longitudinal slot extending over the complete length of the cylinder; a steel strip located at the inner side of the cylinder and sealing the longitudinal slot, which steel strip extends at the area of the piston through same.

Pistons of this kind, which are also termed as piston rod-less pressurized medium cylinders, are generally known. The steel strip which is located at the inner side is arrested, for instance by means of magnets.

2. Description of the Prior Art

A pressurized medium cylinder has been disclosed in the German specification DE-PS 28 33 533, of which the inner chamber having substantially the shape of a circular cylinder is flattened at both sides of the longitudinal slot, such that the steel strip bends to a lesser extent. The steel strip is chamfered at its inner side in the area of its longitudinal edges.

A further pressurized medium cylinder of the kind referred to above is disclosed in the publication WO 83/02306, at which arresting members for a clamping into the side walls of the longitudinal slot are arranged at the side of the sealing strip of steel facing outwards. Such arresting member may be, for instance, a continuous profiled member of a plastic material having a U-shaped cross section, of which the legs are prestressed outwardly or such can be pairs of individual metal clamps. The object of these arresting members is to arrest the steel strip at the area of the slot such that magnets are no longer needed.

According to, furthermore, the specification EP-B1-69199 it is also known to place a plastic strip at the inner side and a further plastic strip at the outside of the tube, which two strips are arrested or held, respectively, at each other in a zipper-like fashion in such a manner, that the inner sealing strip is fixedly held by an outer sealing strip.

Further pressurized medium cylinders of the kind referred to above are disclosed in the European Patent Publications EP-A-260344 and EP-A-147803 and the British Patent Publication GB-A-2163499.

Due to their longer useful lifetime sealing strips made of steel are preferred.

A problem encountered at long cylinders is that the sealing strip can move laterally, i.e. orthogonally to the longitudinal extent of the cylinder. This moving cannot be prevented by the magnets because their force acts substantially in a radial direction relative to the cylinder.

SUMMARY OF THE INVENTION

Hence, it is a general object of the present invention to provide a pressurized medium cylinder having a strip which is arrested against lateral movements such that the useful lifetime of the sealings and of the seal is guaranteed.

A further object of the invention is to provide a pressurized medium cylinder which comprises a continuous strip of a plastic material mounted to the side of the steel strip which faces outwards, which strip of a plastic material has a width which is smaller than the distance between the walls of the longitudinal slot.

Such a plastic material strip allows a positioning or centering, respectively, of the metallic sealing strip relative to the longitudinal slot in a very simple manner. It thereby can be specifically foreseen, that the arrangement of the plastic strip on the steel strip corresponds to the spatial arrangement between steel strip and longitudinal slot. It is, thereby, sufficient to select the width of the plastic strip to be somewhat smaller than the width of the longitudinal slot because this causes a sufficient centering of the sealing strip.

Due to its simplicity the mounted strip features the advantage of not being subjected to friction due to a prestressing of material at the slotted wall, whereby it must not perform the duty of known solutions of arresting the strip in its initial position when the pressurized medium cylinder is not subjected to a pressure.

A further object of the invention is to provide a pressurized medium cylinder, wherein the strip of a plastic material encases the steel strip, in that it is injection molded around the steel strip. By such plastic encasing of the steel strip quite obviously the entire surface of the steel strip is covered by a plastic material, which, however, is not disturbing at all because the arresting force of the magnets is dimensioned sufficiently.

By this kind of injection molded plastic encasing any kind of desired shapes of the profile can be produced, therefore also the arranging of the strip of plastic material at the outside of the steel strip.

Still a further object is to provide a pressurized medium cylinder, in which the cross section of the steel strip is of a rectilinear shape and also, as generally known, in which the steel strip is broader than the longitudinal slot.

Still a further object of the invention is to provide a pressurized medium cylinder, in which the cylinder comprises a recess at its inner side at both sides of the edges of the longitudinal slot, whereby the steel strip encased by the plastic material is located in the recess, which is filled out by the encasing plastic material. By means of such design the transitions at the side edges of the sealing strip can be mounted in an improved manner because they no longer are located in the inner chamber of the cylinder. It is also no longer necessary to have the steel strip chamfered at its inner side as is generally the case of the strips designed in accordance with the prior art.

A further object of the invention is to provide a pressurized medium cylinder, in which the inner surface of the encasing plastic material is located in the cylinder surface of the inner chamber of the pressurized medium cylinder. This means now, that the sealing strip does no longer disturb the surface of the circular cylinder of the inner chamber, such that the seals located at the end of the piston allow an increased useful lifetime and an improved sealing.

A still further object of the invention is to provide a pressurized medium cylinder, in which the inner side of the recess and the outer side of the encasing plastic material extend curvilinearly or rectilinearly.

A further object is to provide a pressurized medium cylinder, in which the inner side of the recess and the outer side of the encasing plastic material match in such a manner that upon a widening of the longitudinal slot a sliding off of the encasing plastic material on the recess proceeds without a forming of an interstice. By means of such a structure the sealing property is kept up also in case of extremely long cylinders, in which when pressure is applied in the inner chamber a certain widening of the longitudinal slot is produced.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENTS

Figure 1:
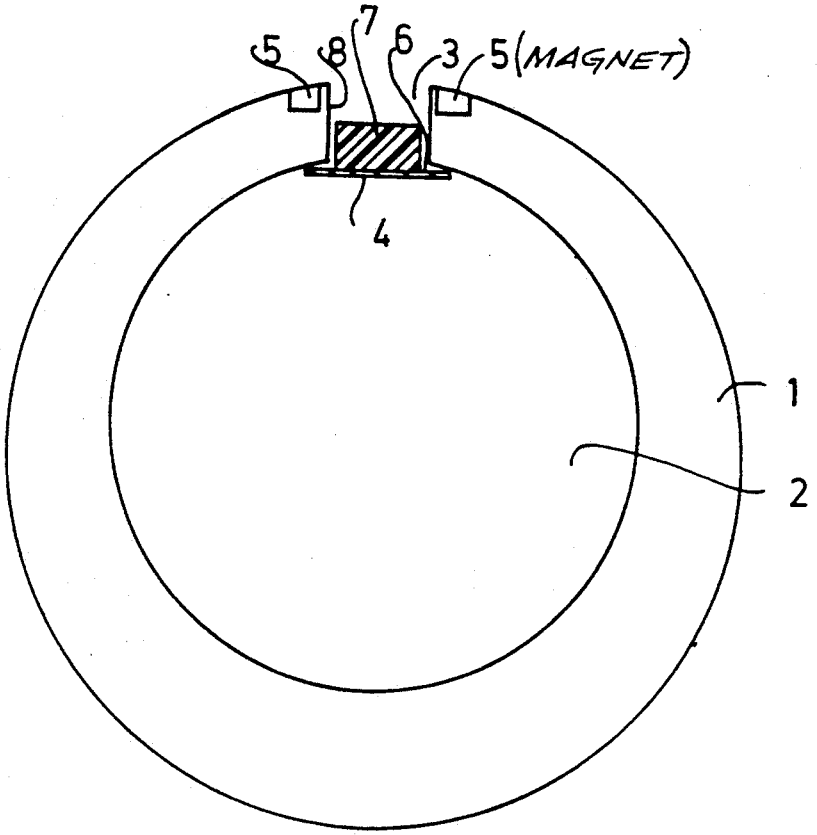
FIG. 1 illustrates a vastly simplified cross section through a pressurized medium cylinder structured in accordance with the invention.

The pressurized medium cylinder illustrated in section in FIG. 1 comprises a casing 1 which consists, for instance, of aluminum. This casing 1 contains an inner chamber 2 having the shape of a circular cylinder, which inner chamber 2 is arranged eccentrically relative to the cylindrical casing 1 and which extends over the entire length of the cylinder. The cylinder is shut off at both its ends. A not particularly illustrated piston is located in the inner chamber 2, which piston is reciprocably movable in the longitudinal direction of the cylinder. The piston is driven, in that a pressure acts onto one of the sides of the piston in the inner space 2, which exceeds the pressure at the opposite side. The casing 1 includes a longitudinal slot 3 extending in the longitudinal direction thereof and a projection connected to the piston extends through this slot 3. The force produced by the piston is taken off at the part of this projection located outside of the casing 1. The longitudinal slot 3 is sealed by a steel strip 4 from or at, respectively, the inner side of the cylinder. The width of the steel strip 4 is larger than the width of the longitudinal slot 3. In order to keep the steel strip in the sealing position illustrated in the figure magnets 5 are set at both sides of the longitudinal slot 3 from the outside into the casing wall. There may be, for instance, individual magnets 5 distributed over the length of the cylinder. These magnets 5 hold the steel strip 4 arrested when the inner chamber 2 is not pressurized.

The magnets 5 generate a force which acts substantially radially onto the steel strip 4. This force would still allow the steel strip to move sideways, i.e. based on the illustration of FIG. 1 towards the left or towards the right. In order to prevent this movement a strip 7 of a plastic material is mounted to the outer side 6 of the steel strip 4 located according to the illustration of FIG. 1 on the top and facing outwards. The width of the plastic strip 7 is, as illustrated in FIG. 1, somewhat smaller than the distance between the side walls 8 of the longitudinal slot 3. By means of this design the steel strip 4 is centered relative to the longitudinal slot 3 and its lateral movement is limited to a small distance. The plastic strip 7 is not only used for fixing or arresting, respectively, the sealing strip at the cylinder casing 1. The cross section of the plastic strip 7 corresponds about to the cross section of the longitudinal slot, i.e. in case of parallel side walls 8 the corresponding side surfaces of the plastic strip 7 extend also parallel to each other. The plastic strip 7 is mounted to the outer side 6 of the steel strip 4 in such a manner as it corresponds to the desired locating of the steel strip 4 relative to the slot 3. If the desired locating is a centering of the steel strip 4 relative to the longitudinal slot 3, the plastic strip 7 is also centered.

Figure 2:
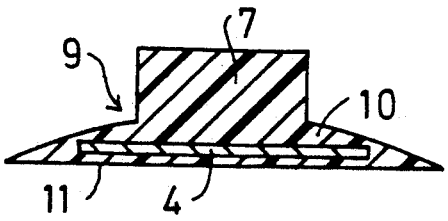
FIG. 2 illustrates on a somewhat enlarged scale a cross section of a modified sealing strip.

According to the embodiment illustrated in FIG. 1 the plastic strip 7 is only mounted to the outer side 6 of the sealing strip 4 consisting of steel, it may be, for instance, mounted by means of an adhesive agent. The embodiment according to FIG. 2 illustrates a sealing strip 9 which is encased by an injection molded plastic forming thus a plastic encasing 10. This plastic encasing 10 forms at the outer side 6 of the steel strip 4 the plastic material strip 7 which is already present in the embodiment of FIG. 1. Additionally, however, the plastic encasing 10 is designed in such a manner, that it has a crosssectional shape of a segment of a circle, of which the chord 11 located at the inner side extends parallel to the steel strip 4 encased by the plastic. The sealing strip 9 of FIG. 2 can be used in a cylindrical casing structured in accordance with FIG. 1. This plastic encasing is a specifically preferred possibility of mounting the plastic strip 7 to the outer side 6 of the steel strip 4. Furthermore, the encasing plastic forms an improvement of the sealing properties.

Figure 3:
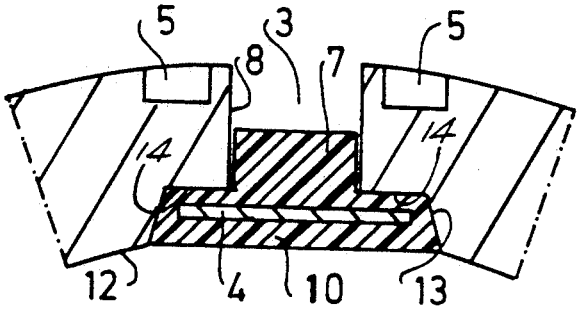
FIG. 3 illustrates a portion of a section through a sealing strip and the longitudinal slot.

FIG. 3 illustrates a further embodiment, in which the inner side 12 of the cylindrical casing 1 includes recesses 13 located at both sides of the longitudinal slot 3, which extend in the longitudinal direction of the casing 1. The two recesses 13 are mirror images of each other. They include a planar shoulder 14 which extends in a chord-like state relative to the inner chamber 2 of the cylinder. The recess 13 broadens proceeding from the shoulders 14 in the direction to the inner chamber.

In this embodiment the plastic encasing 10 of the steel strip 4 is designed in such a state that it not only forms the plastic material strip 7 at the back side 6 of the steel strip 4, but comprises a cross section, which completely fills the recesses 13 at both sides of the longitudinal slot 3. Similar to the embodiment according to FIG. 2 this plastic encasing 10 cooperates also here for the sealing. However, here again the arresting of the steel strip 4 is accomplished by magnets 5.

Figure 4:
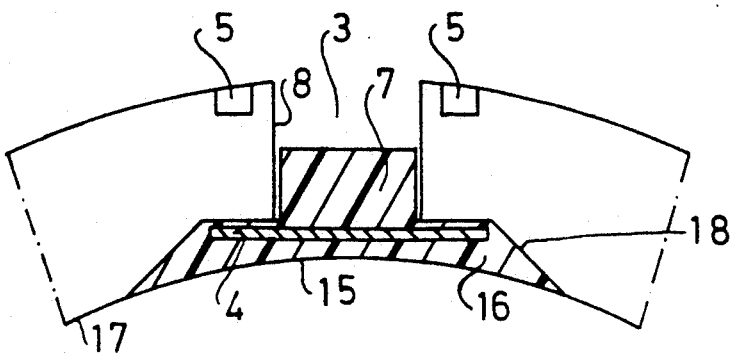
FIG. 4 is an illustration corresponding to the one of FIG. 3 of a further embodiment.

According to the embodiments of FIGS. 2 and 3 the side of the plastic encasing facing towards the inside is of a planar shape and extends, therefore, into the inner chamber 2 having the shape of a circular cylinder. In contrast thereto, the inner surface 15 of the plastic encasing 16 of the embodiment according to FIG. 4 is curved in such a manner that it is aligned with the inner surface of the cylinder 1, i.e. that it actually forms a part of the inner surface 17 of the cylinder. In other words, the surface of the inner chamber 2 is not disturbed or interrupted, respectively, by the sealing strip 9 of the embodiment according to FIG. 4.

Furthermore, the side flanges 18 of the recess according to the embodiment of FIG. 4 extend pronounced obliquely and, therefore, extend relatively flat. Accordingly, relatively long surfaces are formed between the recess and the plastic encasing 16. When the longitudinal slot of the embodiment according to FIG. 4 breathes somewhat, i.e. broadens somewhat, the plastic encasing can glide to a certain extent on the recess due to the rather long side flanges 18 such that no interstice is formed thereat, through which a pressurized medium could escape.

Figure 5:
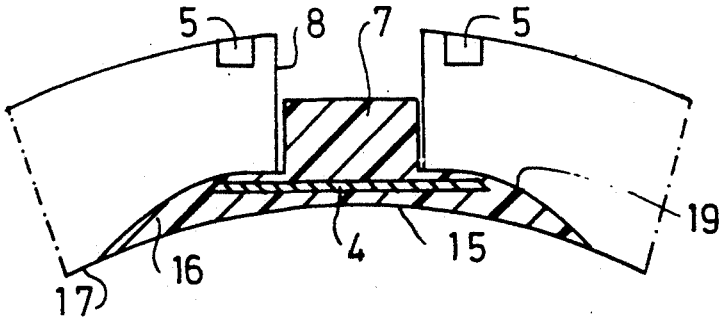
FIG. 5 is an illustration similar to FIGS. 3 and 4 of a still further modified embodiment.

In the embodiment of FIG. 5 this possibility is improved still further, in that the recess 19 has a curvilinear cross section without the longitudinal edge present in the embodiments of FIGS. 3 and 4. The inner surface 15 of the plastic encasing 16 of the embodiment according to FIG. 5 is also arranged and shaped in such a manner, that it does in no way interrupt the inner surface 17 of the cylindrical inner chamber 2, thus no discontinuities.

Quite obviously, the contact surface of the recess can be also designed in such a manner that in case of a broadening of the slot a gliding of the plastic encasing on this recess can occur without an interstice being formed.

While there are shown and described present preferred embodiments of the invention, it is to be distinctly understood that the invention is not limited thereto, but may be otherwise variously embodied and practiced within the scope of the following claims.

I claim:

1. Apparatus comprising a pressurized medium cylinder having an inner chamber and a piston arranged for reciprocable motion in said inner chamber;

a longitudinal slot extending over the complete length of the cylinder;

a steel strip located at the inner side of the cylinder and sealing the longitudinal slot, which steel strip extends at the area of the piston through same;

a continuous strip of plastic material mounted to the side of the steel strip which faces outwards, which strip of plastic material has a width which is smaller than the distance between the walls of said longitudinal slot so as to permit a small amount of lateral movement of said steel strip relative to said slot; and means for biasing said steel strip radially outwardly and toward said slot such that said plastic strip is substantially free of friction as said plastic strip moves radially relative to said cylinder.

2. The pressurized medium cylinder of claim 1, in which the cross section of the steel strip is of a rectilinear shape.

3. The pressurized medium cylinder of claim 1, wherein said strip of plastic material is located centrally between the side edges of the steel strip.

4. The pressurized medium cylinder of claim 1, wherein both sides of said strip of plastic material are spaced from the walls of the longitudinal slot.

5. The pressurized medium cylinder of claim 1, wherein the strip of plastic material encases the steel strip.

6. The pressurized medium cylinder of claim 5, in which the cylinder has an inner surface defining the inner chamber, and in which the plastic material has a curved inner surface aligned with the inner surface of the pressurized medium cylinder.

7. The pressurized medium cylinder of claim 5, in which the cylinder comprises at its inner side at both sides of the edges of the longitudinal slot a respective recess and in which the steel strip encased by plastic material is located in the recesses which are filled out by the plastic material.

8. The pressurized medium cylinder of claim 7 in which the recesses have respective inner sides and the plastic material has an outer side, and in which the inner side of the recess and the outer side of the plastic material match in such a manner that upon a widening of the longitudinal slot the plastic material slides in the recess without forming an interstice.

9. The pressurized medium cylinder of claim 7 in which the recesses have respective inner sides and the plastic material has an outer side, and in which the inner sides of the recesses and the outer side of the plastic material extend curvilinearly.

10. The pressurized medium cylinder of claim 7 in which the recesses have respective inner sides and the plastic material has an outer side, and in which the inner side of the recess and the outer side of the plastic material extend rectilinearly.

11. Apparatus comprising a pressurized medium cylinder having a longitudinal axis and an inner chamber and having therein a longitudinal slot centered on a plane including said axis, said slot being defined by opposed walls parallel to said plane, a piston arranged for reciprocable motion in said inner chamber, a steel strip sealing the inside of said slot, said strip having an outer side and extending through said piston, magnetic means for biasing said steel strip outwardly and toward said slot, and a continuous plastic strip mounted to said outer side of said steel strip, said plastic strip extending into said slot so as to limit lateral movement of said steel strip relative to said slot, and said plastic strip, when centered in said slot, being spaced from all of said opposed walls parallel to said plane.

12. Apparatus comprising a pressurized medium cylinder having a longitudinal axis and an inner chamber and having therein a longitudinal slot, said slot being defined by opposed walls, a piston arranged for reciprocable motion in said inner chamber, a steel strip sealing the inside of said slot, said strip having an outer side and extending through said piston, and a continuous plastic strip mounted to said outer side of said steel strip, said plastic strip extending into said slot so as to limit lateral movement of said steel strip relative to said slot, and said plastic strip, when centered in said slot, being free of frictional engagement with either said walls or an outer sealing strip.

13. Apparatus as set forth in claim 12 and further comprising magnetic means for biasing said steel strip outwardly and toward said slot.

* * * * *